US007493791B2

(12) United States Patent
Chadbourne

(10) Patent No.: US 7,493,791 B2
(45) Date of Patent: Feb. 24, 2009

(54) ELECTRICAL CONNECTOR CRIMP DIE WITH CRIMP OVERLAP INDICIA FORMING

(75) Inventor: Christopher G. Chadbourne, Nashua, NH (US)

(73) Assignee: FCI Americas Technology, Inc., Carson City, NV (US)

( * ) Notice: Subject to any disclaimer, the term of this patent is extended or adjusted under 35 U.S.C. 154(b) by 166 days.

(21) Appl. No.: 11/495,854

(22) Filed: Jul. 27, 2006

(65) Prior Publication Data

US 2008/0022749 A1 Jan. 31, 2008

(51) Int. Cl.
*B21D 37/10* (2006.01)

(52) U.S. Cl. ..... 72/416; 72/412; 72/409.19

(58) Field of Classification Search ..... 72/416, 72/412, 409.01, 409.19, 409.14, 409.06, 72/370.21, 370.16; 29/861, 871, 863; 101/28–31.1
See application file for complete search history.

(56) References Cited

U.S. PATENT DOCUMENTS 2,639,754 A * 5/1953 Macy ..... 72/411
2,921,618 A * 1/1960 Fuller ..... 72/308
3,055,412 A * 9/1962 Dibner ..... 72/470
3,120,772 A * 2/1964 Mixon, Jr. ..... 72/409.14
3,175,281 A * 3/1965 Elfsten ..... 29/890.144
4,047,420 A * 9/1977 Edwards ..... 72/416
4,353,240 A 10/1982 Undin et al. ..... 72/410
5,084,963 A 2/1992 Murray et al. ..... 29/863
5,195,352 A * 3/1993 Grois et al. ..... 72/409.16
5,257,525 A * 11/1993 Clarke ..... 72/402
5,697,246 A * 12/1997 Kuroda et al. ..... 72/356
5,722,991 A * 3/1998 Colligan ..... 606/223
6,101,862 A 8/2000 Rzasa et al. ..... 72/413
6,470,571 B1 * 10/2002 Namiki ..... 29/896.41
2001/0002508 A1 * 6/2001 Yamakawa ..... 29/753
2004/0227346 A1 11/2004 Jamison et al. ..... 285/381.3

* cited by examiner

*Primary Examiner*—Dana Ross
*Assistant Examiner*—Debra M Sullivan
(74) *Attorney, Agent, or Firm*—Harrington & Smith, PC

(57) ABSTRACT

An electrical connector crimp die including a main body and an indicia forming section. The main body has a connector contacting surface between opposite ends of the main body. The indicia forming section is on the connector contacting surface. When the crimp die forms a crimp on an electrical connector, the indicia forming section is adapted to form an alignment indicia on the electrical connector for subsequent alignment of the die with the crimp to form a subsequent overlapping crimp.

8 Claims, 5 Drawing Sheets

ELECTRICAL CONNECTOR CRIMP DIE WITH CRIMP OVERLAP INDICIA FORMING

BACKGROUND OF THE INVENTION

1. Field of the Invention

The invention relates to crimping an electrical connector onto an electrical conductor and, more particularly, to a crimp die adapted to form a crimp overlap indicia.

2. Brief Description of Prior Developments

Many electrical conductor transmission or distribution splice electrical connectors have substantial overall length in order to help carry very high mechanical and electrical loads. These connectors are often crimped with mechanical or hydraulic crimping tools, and employ the common practice of recommending that crimps 'overlap'. This overlapping process is important for a number of reasons; namely, that the outside surface of the crimped connection is flat without any sharp edges to prevent corona discharge, and also so that the force per unit area applied to the connection is consistent along the entire length of the crimped connection, resulting in consistent conductor strand loading along the entire length of the connection. Further, many of these connectors are designed with a taper at each end, again to prevent corona discharge, but also so that the transition of mechanical stresses from the un-crimped conductor to the fully crimped conductor inside the barrel of the connector is gradually transitioned. This prevents stress concentrations on individual strands which, when exposed to high tensile loads, may fail prematurely if the stress is not transitioned appropriately.

It is common practice for manufacturers of crimp dies, crimp tools, and electrical connectors to design connector installation tools of various output forces, in order that they may be used in particular markets or used in particular applications. Tools which are designed with 'low' output forces, such as about 12-15 tons of output force to the connector, would utilize crimp dies that have a given geometry (such as crimp groove radius, relief angle, and break edge radius) that are common to many types of die platforms, with the exception that the 'width' of the die is small to compensate for the relatively low tonnage of the crimping tool. Likewise, a tool which is designed with a 'high' output force, such as 60 tons for example, often employ the same crimp groove geometry except that the plow-width is substantially greater, because the tool output is so much greater. Sometimes there is even a direct relationship between output force and plow width. An example may be that a crimp die for a 60 ton tool will have a plow width of 2 inches, and a die with the same crimp groove geometry for a 15 ton tool will have a plow width of 0.5 inch. This 4:1 ratio (as an example) allows different tools to be used on the same connector, resulting in a nearly identical crimp dimension, regardless of the output force of the tool.

Often times, as previously stated, care is given to insure that the user 'overlap' crimps by stamping into the given connector the statement 'OVERLAP CRIMPS' by the manufacturer of the connector. However, there is no mention given to the amount that these crimps should be overlapped, nor is there a current means to suggest or instruct the user how to consistently overlap these crimps to optimize the force imparted on the connector during the installation process; besides the common practice of 'eye-balling' it. Connectors could be pre-marked, but markings are very often obliterated during the crimping process, rendering the pre-marking useless.

There is a need for a system which can provide a user a means for positioning a crimp die on an electrical connector for forming repeatable, consistent overlapping crimps on the electrical connector; thereby optimizing the overlapping crimp process.

SUMMARY OF THE INVENTION

In accordance with one aspect of the invention, an electrical connector crimp die is provided including a main body and an indicia forming section. The main body has a connector contacting surface between opposite ends of the main body. The indicia forming section is on the connector contacting surface. When the crimp die forms a crimp on an electrical connector, the indicia forming section is adapted to form an alignment indicia on the electrical connector for subsequent alignment of the die with the crimp to form a subsequent overlapping crimp.

In accordance with another aspect of the invention, an electrical connector crimp die is provided comprising a main body and a first alignment indicia forming section. The main body has a connector contacting surface between opposite ends of the main body. The first alignment indicia forming section is on the connector contacting surface. The first alignment indicia forming section comprises at least one recess and/or projection on the connector contacting surface adapted to form a first alignment marking on an electrical connector when a first crimp is formed on the electrical connector by the crimp die. The first alignment indicia forming section is adapted to form the alignment marking generally parallel to, and spaced from, a first one of the ends of the main body. When the crimp die forms the first crimp on the electrical connector, the alignment marking is adapted to be used by a user to align the crimp die on the electrical connector to form a subsequent crimp which overlaps the first crimp.

In accordance with another aspect of the invention, a method of crimping an electrical connector onto an electrical conductor is provided comprising forming a first crimp on the electrical connector by a crimp die; forming an alignment indicia on the electrical connector by the crimp die during the forming of the first crimp, wherein the alignment indicia is spaced inwardly from an end edge of the first crimp; after forming the first crimp, aligning a portion of the crimp die with the alignment indicia; and forming a second subsequent crimp on the electrical connector which at least partially overlaps the first crimp.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
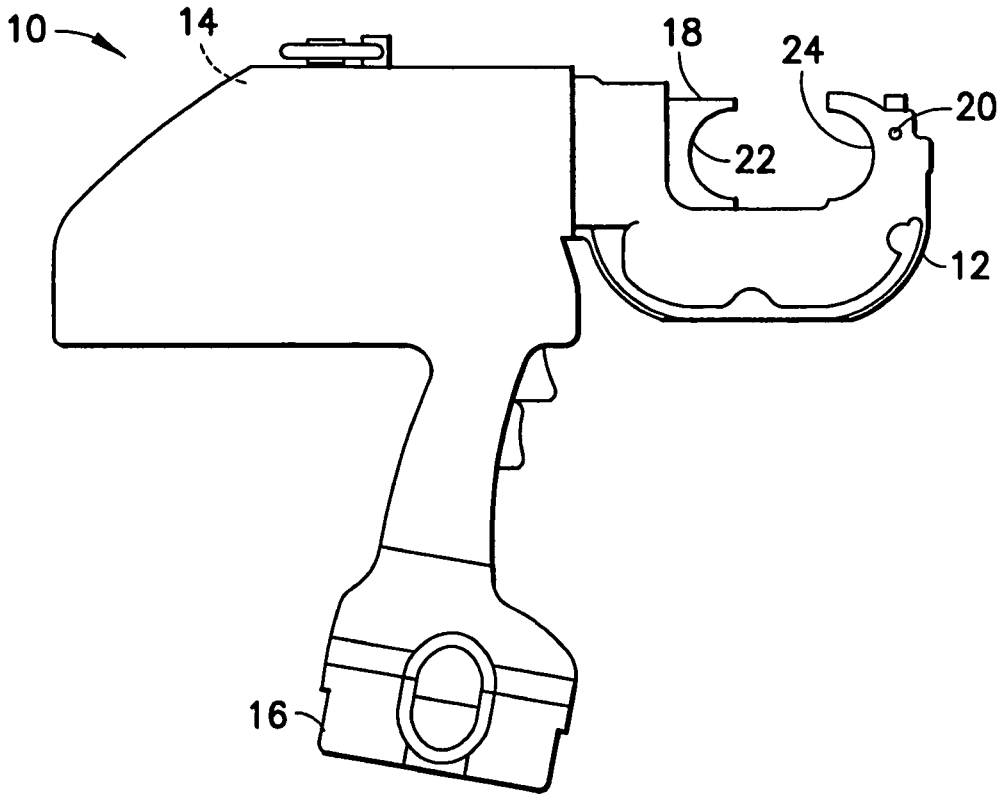
FIG. 1 PRIOR ART
FIG. 1 is a side view of a battery operated hydraulic crimping tool for use with a die set comprising features of the invention.

Referring to FIG. 1, there is shown a side view of a conventional hydraulic crimping tool 10. The tool 10 is a battery actuated tool adapted to removably receive crimp dies at its working head 12. The tool 10 is a PATRIOT® hydraulic crimping tool sold by FCI USA, Inc. of Manchester, N.H. The tool 10 generally comprises a hydraulic drive system 14, which is powered by a removable rechargeable battery 16, to drive a ram 18 towards an anvil section 20 of the working head 12. The front of the ram 18 and the anvil section 20 each comprise a seat 22, 24 for removably receiving a crimp die. However, features of the invention could be used with any suitable type of crimping tool including a manual crimping tool, a non-battery actuated crimping tool, and/or a crimping tool with a fixed (non-removable) die set.

Figure 2:
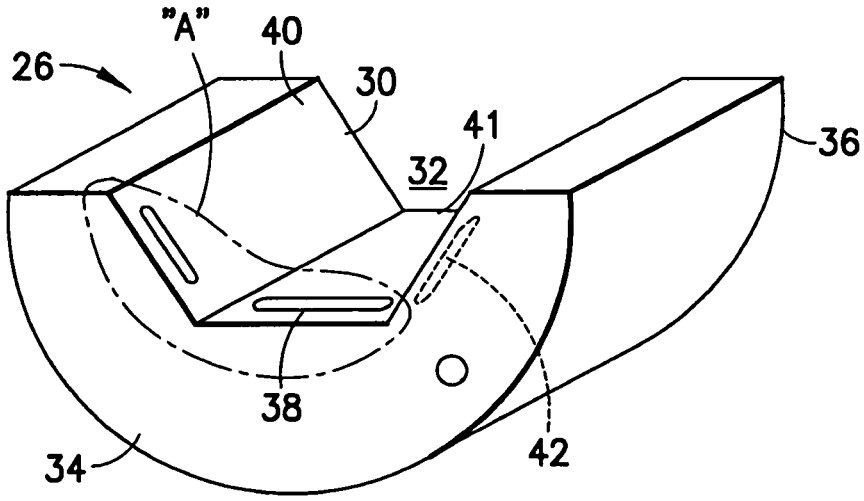
FIG. 2 is a perspective view of one of the dies incorporating features of the invention.

Referring also to FIG. 2, a perspective view of one embodiment of a crimp die 26 incorporating features of the invention is shown. Although the invention will be described with reference to the exemplary embodiments shown in the drawings, it should be understood that the invention can be embodied in many alternate forms of embodiments. In addition, any suitable size, shape or type of elements or materials could be used.

Figure 3:
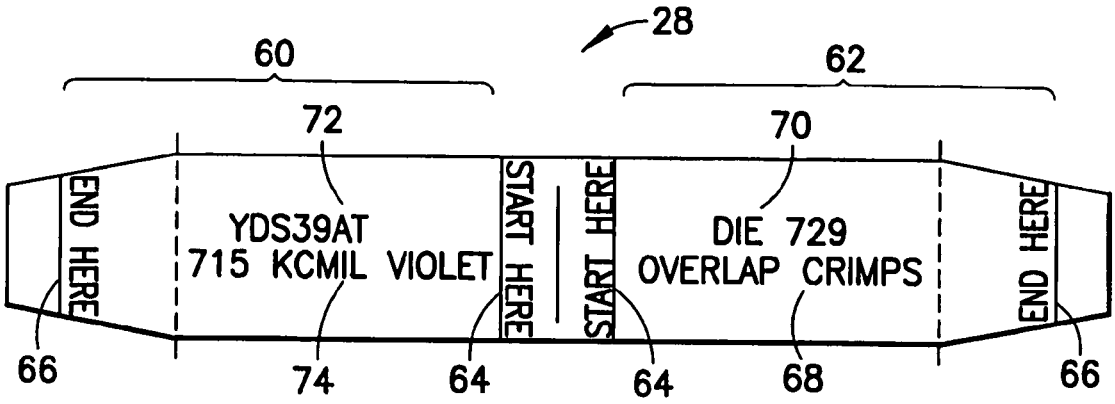
FIG. 3 is a side view of an electrical connector to be crimped with the tool shown in FIG. 1 and the die shown in FIG. 2.

The crimp die 26 is a one-piece member made of metal. The die 26 is used with another die to form a die set. The die set is mounted in the pair of seats 22, 24. When the ram 18 is moved towards the anvil section 20, the die set is able to crimp an electrical connector onto one or more electrical conductors between the dies. FIG. 3 shows an example of a splice electrical connector 28 which can be crimped by the crimp die 26 onto two electrical conductors to splice the conductors together.

Figure 4:
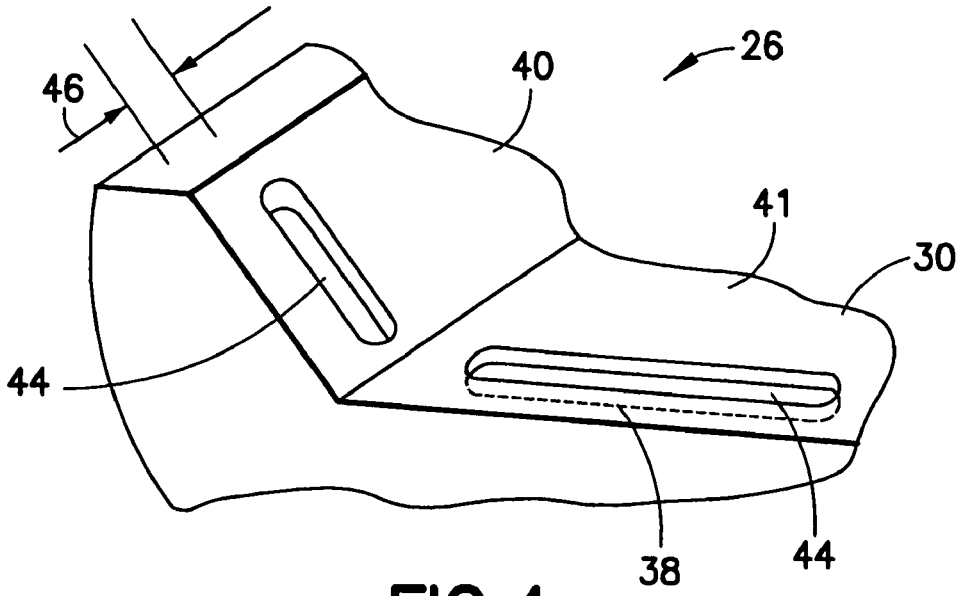
FIG. 4 is an enlarged view of a portion of the die shown in FIG. 2.

The crimp die 26 comprises a main body with a connector contacting surface 30. In this embodiment the surface 30 comprises multiple surfaces 40, 41, 42 which are angled relative to each other to form a connector receiving area or channel 32 between opposite ends 34, 36 of the main body. In an alternate embodiment the channel could have a curved concave surface. In another alternate embodiment, the connector contact surface provided by the die could have a convex shape. The die 26 also comprises an indicia forming section 38 on the connector contacting surface 30. Referring also to FIG. 4, in this embodiment the indicia forming section 38 comprises multiple recesses or grooves 44 extending into the connector contacting surface 30. However, in alternate embodiments only one recess might be provided.

In the embodiment shown, the recesses 44 are aligned in a line generally parallel to the end 34 and spaced from the end 34 by a distance 46. In an alternate embodiment the recesses 44 might be slightly offset. In another embodiment the indicia forming section might not have a general line configuration. For example, the indicia forming section might merely comprise two dimple type of holes equally spaced from the end 34, or a triangular shape with a flat side facing and parallel to the end 34. These are only some examples. Those skilled in the art can devise alternatives to accomplish the marking or indicia function of the indicia forming section as understood after reading this disclosure. The grooves 44 could be milled as pockets. Preferably, the pockets will create a slight positive impression on the crimp allowing easy alignment of the impression with the edge of the die set for the next crimp. The locator could also be a scribed line, positive bump, or any other geometry.

Figure 5:
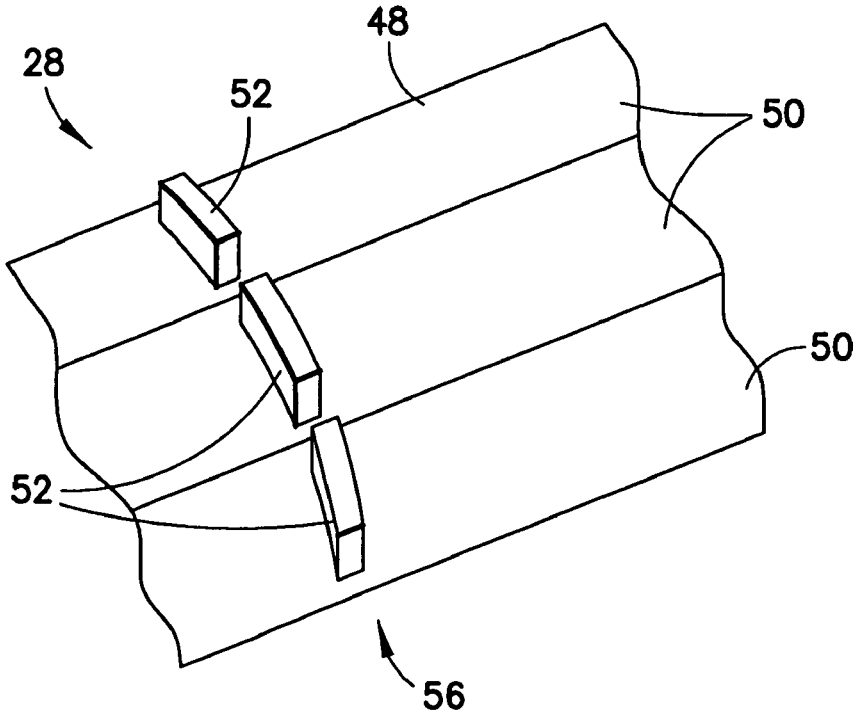
FIG. 5 is a perspective view of a portion of the connector shown in FIG. 3 after being crimped with the die shown in FIG. 2.

Referring also to FIG. 5, a portion of the electrical connector 28 is shown after being crimped with the die 26. The crimp 48, in this embodiment, has angled sides 50 corresponding to the surfaces 40-42 indenting the outer surface of the electrical connector 28. The crimp 48 also has projections 52. The projections 52 are formed by the recesses 44 of the indicia forming section 38. More specifically, as the indented sides 50 are formed by the surfaces 40-42, portions of the electrical connector 28 are able to deform into the recesses 44 to thereby form the projections 52.

Figure 6:
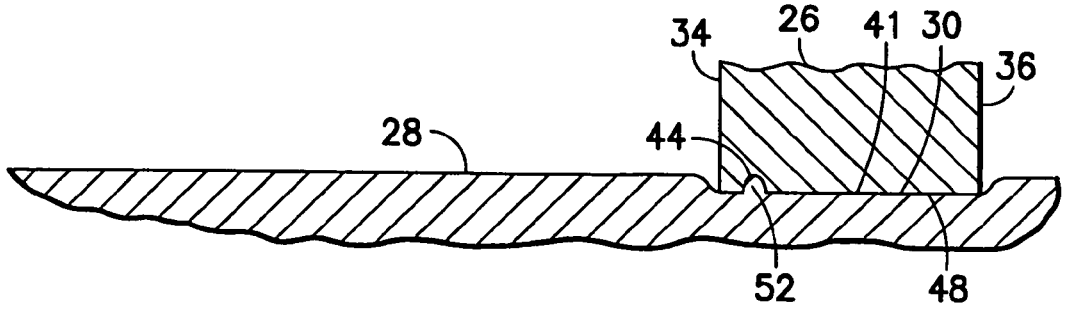
FIGS. 6-9 are cross sectional views showing the process for using the die shown in FIG. 2 to sequentially crimp the connector along a portion of its length.
Figure 7:
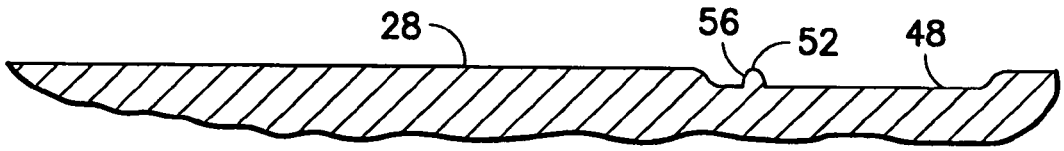

Referring also to FIGS. 6-7, the die 26 is shown forming the crimp 48 by indenting or deforming the outer surface of the connector 28 inward. When the die 26 is removed as seen in FIG. 7, the crimp 48 includes the projections 52. Because the recesses 44 are aligned in a line generally parallel to and spaced from the end 34 of the die, the projections 52 are formed in a line generally parallel and spaced from an end of the crimp 48. The projections form an alignment indicia or marking 56 on the electrical connector for subsequent alignment of the die 26 with the crimp 48 to form a subsequent overlapping crimp.

Figure 8:
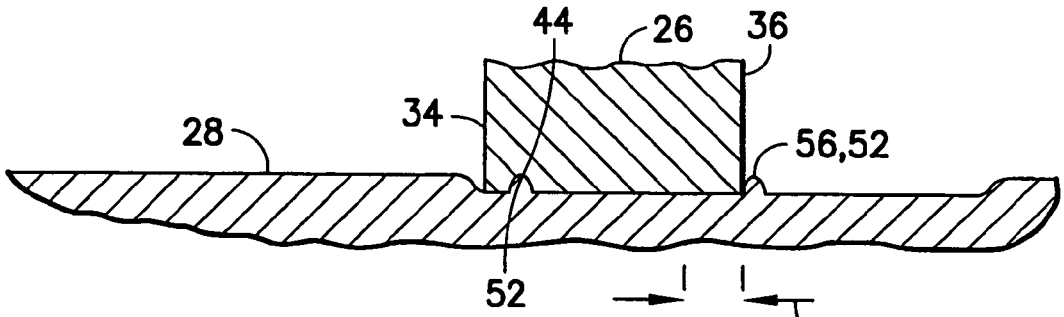
Figure 9:
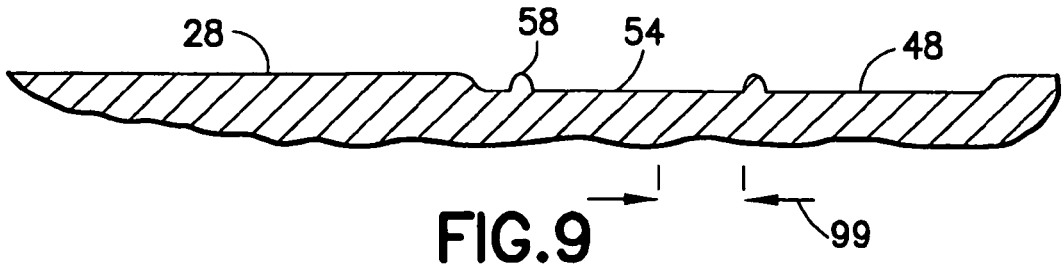

Referring also to FIGS. 8 and 9, the formation of a second overlapping crimp 54 is shown. After formation of the first crimp 48, the tool 10 is moved by the user to locate the second end 36 of the crimp die 26 at the indicia 56 and performs a second crimping operation. This results in the second crimp 54 being formed along with a second series of projections 52 to form a second indicia 58. Area or length 99 is an overlapping area which is consistently repeatable. This process can be repeated in series as many times as desired to crimp the entire desired crimp area of the electrical connector 28. The method can comprise forming a first crimp on the electrical connector by a crimp die; forming an alignment indicia on the electrical connector by the crimp die during the forming of the first crimp, wherein the alignment indicia is spaced inwardly from an end edge of the first crimp; after forming the first crimp, aligning a portion of the crimp die with the alignment indicia; and forming a second subsequent crimp on the electrical connector which at least partially overlaps the first crimp. The invention provides a system which can provide a user a means for positioning a crimp die on an electrical connector for forming repeatable, consistent overlapping crimps on the electrical connector; thereby optimizing the overlapping crimp process.

Figure 10:
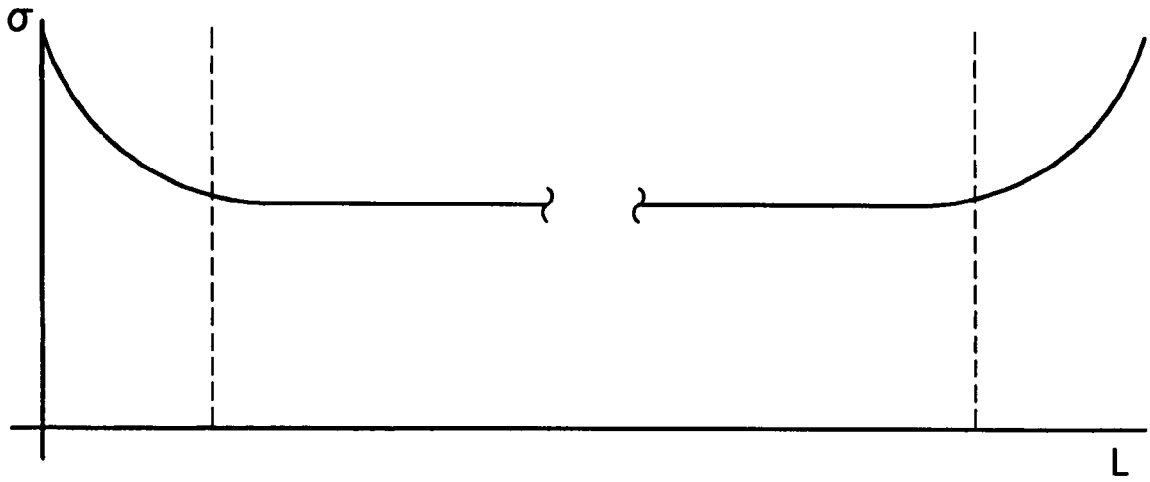
FIG. 10 is a chart showing strain on the connector shown in FIG. 3 by crimping along its length.

For the splice electrical connector 28 shown in FIG. 3, two crimp areas 60 and 62 are included; one area for each of the electrical conductors being spliced. FIG. 3 shows the splice connector 28 with indicia provided by the manufacturer of where to start 64 and where to end 66 the series of crimps at each area 60, 62. FIG. 3 also shows other indicia including an "overlap crimps" indication 68 for the user, a die type indication 70 to indicate what type of crimp die should be used to crimp the connector 28, a model number 72, and a conductor size indication 74. This are only some examples and should not be considered as limiting. FIG. 10 shows a graph of strain along the length of the connector 28 from compression using the die set of the invention. Providing the indicia 56, 58 does not significantly increase or decrease the strain.

Testing has indicated that in some cases, crimp dies with thinner crimping profiles or "plow-widths" have performed to higher values of pullout than their wider die counterparts. The reasoning appears to be that the thinner die profiles do a better job of creating an even stress distribution across the tapered portion of the connector, because the thinner plow width allows for more even compression of the tapered zone of the connector. Further, the thinner plow width creates more contact points between the inside diameter of the connector and the outside strands of the installed conductor. Thus, using multiple smaller width, overlapping crimps may produce better overall connection than using a wider width crimp.

The invention provides a means for the installer of crimped connections to create very consistent overlapped crimps by using crimp dies which, in the preferred embodiment, have indicia on their surface that presses a witness line on the crimped connector; resulting in a very clear means of accurately locating the connector for the subsequent crimp. This 'line' pressed into the connector would then be aligned with the edge of the crimp die, accurately and consistently locating the crimp die relative to the connector for subsequent crimps. The number of crimps that are placed on the connector in this 'marked overlap' scenario is dependent on the length of the connector, the width of the die, the location of the indicia on the die set, and the extrusion characteristics of the electrical connector and the conductor that are being installed. The benefit of this invention is that, with appropriately located indicia on die sets, an optimum overlapping crimp process can be developed for electrical connections that does not currently exist.

Figure 11:
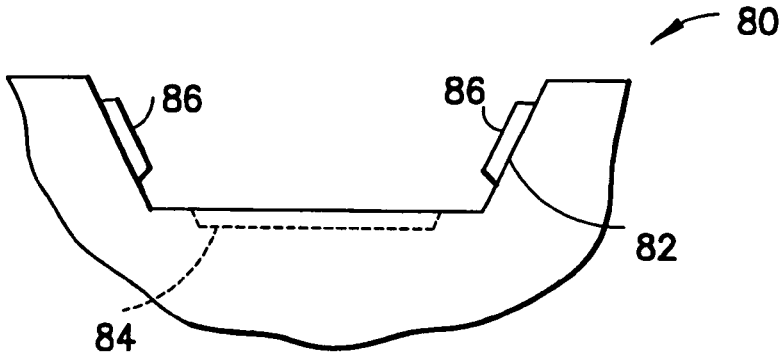
FIG. 11 is a partial end view of an alternate embodiment of the die shown in FIG. 2.

Referring also to FIG. 11, an alternate embodiment of the invention is shown. In this embodiment the die 80 comprises an indicia forming section 82 with a groove or recess 84 and projections 86. The groove 84 can form a projection on the connector and the projections 86 can form recesses in the connector. This illustrates that both grooves and projections can be used to form an indicia, such as a general line shaped indicia for example, in the connector.

Figure 12:
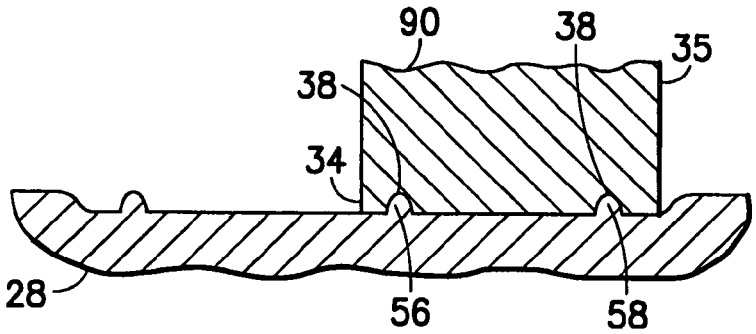
FIG. 12 is a cross sectional view similar to FIG. 8 showing sequential crimping of the connector with an alternate embodiment of the die shown in FIG. 2.

Referring also to FIG. 12, an alternate embodiment of the invention is shown. In this embodiment the die 90 comprises two indicia forming sections 38; one proximate each end 34, 36. One of the indicia forming sections 38 can be aligned over one of the previously formed indicia 56 while forming the second indicia 58.

Figure 13:
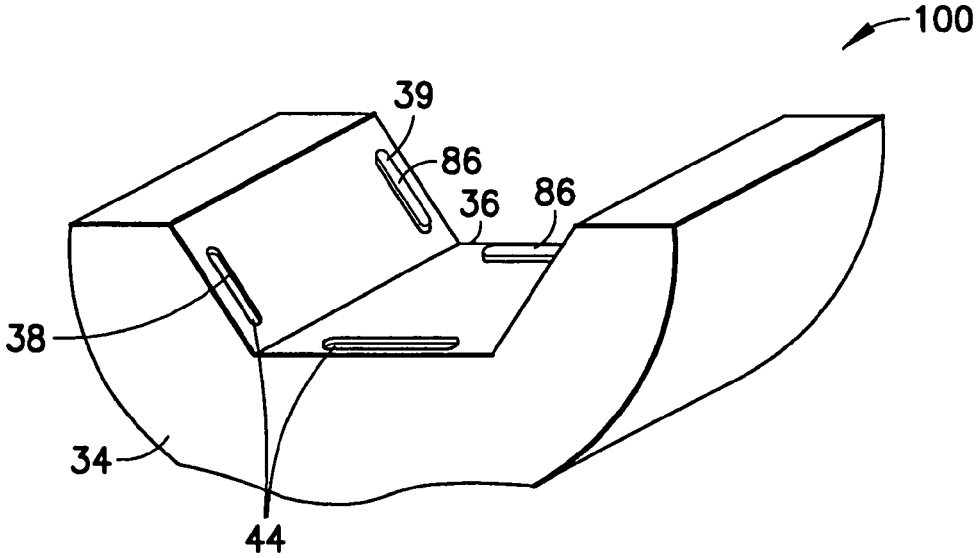
FIG. 13 is a perspective view of another alternate embodiment of the die shown in FIG. 2.

Referring also to FIG. 13, an alternate embodiment of the invention is shown. In this embodiment the die 100 comprises two indicia forming sections 38 and 39; one proximate each end 34, 36. The first indicia forming section 38 comprises grooves 44 located proximate the end 34. The second indicia forming section 39 comprises projections 86 located proximate the end 36.

One basic idea is an electrical connector crimp die with a recessed, embossed, or raised portion. The recessed/raised portion leaves a mark on the crimped electrical connector, which permits accurate, overlapping, sequential alignment of the crimp die along the crimp length of the electrical connector. A recess can create a raised portion on a surface of the electrical connector. The formed raised portion can physically fit inside one of the recesses in the die when the die is moved along the crimp length. Conversely, a raised portion of the die will create a recess in the surface of the electrical connector. The raised portion can then fit inside the recess to allow proper alignment. The raised/recessed portions also provide a visual indication of where the last crimp terminated.

As noted above, it can be desirable to overlap crimps when crimping an electrical connector to a conductor. The problem in the past was that there was no system or method to make the overlapping crimps at consistence locations relative to each other. The common practice of 'eye-balling' it or roughly estimating the overlap distance was inaccurate and resulted in non-consistent crimps from one connector to another. Thus, the quality of the overlapping crimps was variable. The advantage provided by the invention is the ability to produce consistent quality crimped connections by helping to eliminate variations in overlapping crimps. The overlap distance of crimps is kept uniform. Therefore, a consistently repeatable quality product can be produced.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector crimp die comprising:

a main body having a connector contacting surface between opposite ends of the main body; and a first alignment indicia forming section on the connector contacting surface, wherein the first alignment indicia forming section comprises at least one recess and/or projection on the connector contacting surface adapted to form a first alignment marking on an electrical connector when a first crimp is formed on the electrical connector by the crimp die, wherein the first alignment indicia forming section is adapted to form the alignment marking generally parallel to, and spaced from, a first end of the connector contacting surface, wherein the first alignment indicia forming section is integral with the main body as a one-piece member, wherein, when the crimp die forms the first crimp on the electrical connector, the first alignment indicia forming section is configured to form the alignment marking with a size, shape and location to subsequently physically contact and align the crimp die on the electrical connector with the alignment marking being located at least partially inward from the first end of the connector contacting surface, to form a subsequent second crimp which partially overlaps the first crimp, and a second alignment indicia forming section on the connector contacting surface, wherein the second alignment indicia forming section comprises at least one recess and/or projection on the connector contacting surface adapted to form a second alignment marking on the electrical connector when the first crimp is formed on the electrical connector by the crimp die, wherein the second alignment indicia forming section is adapted to form the second alignment marking generally parallel to, and spaced from, a second one of the ends of the main body.

2. An electrical connector crimp die as in claim 1 wherein the connector contacting surface comprises a plurality of surfaces angled relative to one another to form an electrical connector receiving channel.

3. An electrical connector crimp die as in claim 1 wherein the first alignment indicia forming section comprises at least one recess into the connector contacting surface.

4. an electrical connector crimp die as in claim 3 wherein the at least one recess comprises a plurality of recesses aligned in a general line.

5. An electrical connector crimp die as in claim 1 wherein the first alignment indicia forming section comprises at least one projection extending from the connector contacting surface.

6. An electrical connector crimp die as in claim 1 wherein the first alignment indicia forming section comprises at least one recess into the connector contacting surface and at least one projection extending from the connector contacting surface.

7. An electrical connector crimp ale as in claim 6 wherein the at least one recess and the at least one projection are aligned in a general line.

8. An electrical connector crimp die as in claim 3 wherein the recess of the first alignment indicia forming section is spaced inward from the first end of the connector contacting surface, wherein the recess is sized and shaped to form the alignment marking as a projection extending upward from a compressed area of the connector which has been compressed by the connector contacting surface with the projection being inwardly spaced from an end of the compressed area.

* * * * *